United States Patent [19]

Hoffken et al.

[11] Patent Number: 5,058,656

[45] Date of Patent: Oct. 22, 1991

[54] INSTALLATION FOR THE PRODUCTION OF A STEEL STRIP

[75] Inventors: Erich Hoffken, Dinslaken; Hermann Lax, Dusseldorf; Günter Pietzko, Essen, all of Fed. Rep. of Germany

[73] Assignee: Thyssen Stahl AG, Duisburg, Fed. Rep. of Germany

[21] Appl. No.: 522,295

[22] Filed: May 11, 1990

Related U.S. Application Data

[62] Division of Ser. No. 173,847, Mar. 28, 1988, Pat. No. 4,951,734.

[30] Foreign Application Priority Data

Apr. 13, 1987 [DE] Fed. Rep. of Germany ..... 3712537
Jul. 16, 1987 [DE] Fed. Rep. of Germany ..... 3723543

[51] Int. Cl.[5] ..... B22D 11/04; B22D 11/12

[52] U.S. Cl. ..... 164/416; 164/417; 164/444

[58] Field of Search ..... 164/416, 417, 476, 478, 164/486, 418, 444

[56] References Cited

U.S. PATENT DOCUMENTS

| | | | |
|---|---|---|---|
| 3,563,298 | 2/1971 | Stauffer et al. | 164/418 X |
| 4,023,612 | 5/1977 | Jackson | 164/418 X |
| 4,207,941 | 6/1980 | Shrum | 164/418 X |
| 4,537,241 | 8/1985 | Kanamori | 164/444 X |
| 4,635,702 | 1/1987 | Kolakowski et al. | 164/418 |

FOREIGN PATENT DOCUMENTS

| | | | |
|---|---|---|---|
| 2409820 | 9/1975 | Fed. Rep. of Germany | 164/418 |
| 3427756 | 3/1985 | Fed. Rep. of Germany | 164/418 |
| 1505630 | 11/1967 | France . | |
| 56-105856 | 8/1981 | Japan . | |
| 59-97747 | 6/1984 | Japan . | |
| 1014180 | 3/1985 | U.S.S.R. . | |

*Primary Examiner*—J. Reed Batten, Jr.
*Attorney, Agent, or Firm*—Sprung Horn Kramer & Woods

[57] ABSTRACT

The continuous casting installation includes:

a) a funnel-shaped oscillating mold having cooled walls to produce a steel strip having a thickness of 40 to 50 mm; and b) a deforming device disposed at a distance of at most 0.5 m from the mold outlet to squeeze the steel strip to a thickness of not more than 25 mm.

6 Claims, 2 Drawing Sheets

INSTALLATION FOR THE PRODUCTION OF A STEEL STRIP

Figure 1:
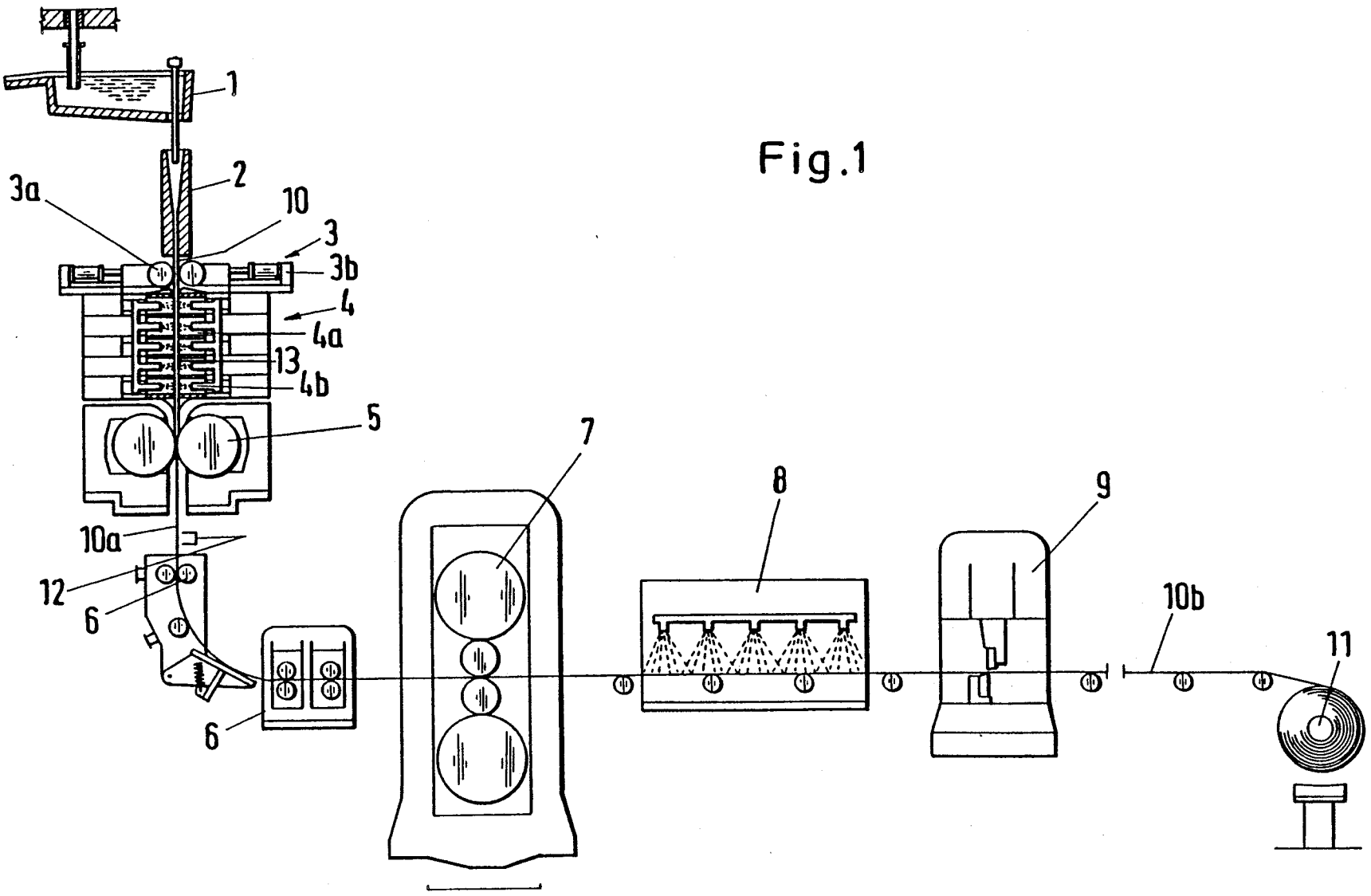

This is a division of application Ser. No. 07/173,847 filed Mar. 28, 1988 and now U.S. Pat. No. 4,951,734.

BACKGROUND OF THE INVENTION

1. Field of the Invention

The invention relates to a process and installation for the production of a steel strip having a thickness of 2 to 25 mm by the casting of a steel strand having a thickness of less than 100 mm, followed by the rolling out of the steel with utilization of the casting heat, the cast strand being subjected in at least one pass to a change in cross-section producing a stretching.

2. Discussion of Prior Art

The idea of producing strips or sheets by rolling a cast strand directly from the casting heat is known. However, such processes have hitherto been used exclusively for low-melting metals, such as brass, copper and aluminium.

The processes used in practice for the production of hot-rolled steel strip having a thickness as well of less than 20 mm as a rule start from a continuously cast slab which after complete solidification is reheated to rolling temperature, reduced in thickness in a number of passes, and rolled out into a strip. For this purpose up to nine roll stands are required, due to the considerable thickness of the slabs used. Installations for the use of such a process call for heavy investment costs, since they require on the one hand a correspondingly large continuous casting installation, and on the other hand demand a multi-roll-stand hot-rolled strip rolling train whose roughing stands must be of suitable compact construction, due to the thickness of the slabs to be rolled out.

To reduce this expense, it has already been suggested to start from cast preliminary strip having a thickness of 20 to 65 mm in the production of thin strips (German OS 32 41 745). The preliminary strip is produced in the continuous casting installation in the conventional manner, being cooled and after complete solidification subdivided into pieces of suitable length and wound into a coil. In preparation for the subsequent rolling out to form the thin strip, the coil is thermally treated in an intermediate storage furnace and adjusted to a uniform temperature. Rolling out is performed in a number of passes. The expense of rolling thin strips still remains high, due to the required intermediate storage furnace and the large number of roll stands.

SUMMARY OF THE INVENTION

It is an object of the invention to provide a process and an installation which can produce in a very simple manner high-quality steel strips having a thickness of 2 to 25 mm.

This problem is solved in a process of the kind specified by the following steps:

a) The casting of a steel strand having a thickness of 40 to 50 mm at a speed of 5 to 20 m/min in an oscillating mold for continuous casting having cooled walls;

b) the not yet completely solidified cast strand is after emergence from the mold so squeezed that the inner walls of the already solidified strand shell are welded to one another.

The use of the steps according to the invention produces a dense strand which is free from shrinkage cavities, whose thickness is substantially reduced in comparison with that of the original steel strand, and which also has over its total cross-section a fine-grained cast structure such as otherwise occurs in a continuously cast steel strand only in the surface adjoining its edge. According to the invention the various parameters of the casting of the steel strand on the one hand and of the reduction in its thickness on the other are so adjusted to one another that the strand shells are resistant enough to withstand the squeezing of the steel strand without break-outs.

When the not yet completely solidified steel strand of 40 to 50 mm is squeezed, steel strands are obtained which have a thickness of 10 to 20 mm. For quite a few applications such thin strips can be used immediately without the need for any further substantial deformation during rolling out. An approximately 5% degree of deformation to improve the surface texture (dressing) may be sufficient. After suitable cooling the strips thus still slightly deformed can be coiled. However, if strips of even smaller thickness are required, according to the invention the cast strand reduced in thickness is cooled to a temperature in the range of 1000° to 1200° C. by spraying a cooling medium on to the surface of the strand and the reduced and to such an extent cooled cast strand is, utilizing the casting heat, rolled out in a strip in at least one pass with a 5 to 85% degree of deformation. Such rolling out enables minimum final dimensions down to about 2 mm to be obtained. The use of the process according to the invention for the production of steel strips of even such minimum thickness is inexpensive, since the manufacturing process requires no large installations with holding furnaces or a large number of roll stands with corresponding energy requirements.

As regards apparatus the problem is solved by an installation which comprises a continuous casting installation having a funnel-shaped, oscillating mold having cooled walls; a deforming device for the strand disposed at the mould outlet. Preferably a cooling device is disposed downstream of the deforming device and a roll stand is disposed downstream of the cooling device.

According to a preferred feature of the process according to the invention, by the squeezing the steel strand is given a cross-section corresponding to the cross-section of the finished strip. This step is important to the process according to the invention, since basic changes in cross-section during rolling out of the strand cannot be carried out in a simple manner.

To obviate surface faults, very advantageously according to another feature of the invention the cast steel strand has a rectangular cross-sectional shape with convexly rounded narrow sides or an oval cross-sectional shape. This shaping ensures that on solidification a strand shell of uniform thickness is produced, so that when the steel strand is squeezed after emerging from the mold in the deforming device no cracks appear in the edge zone or irregularities on the strand surface.

It has proved particularly advantageous if the casting speed and/or the cooling intensity of the mold are so controlled that when the steel strand emerges from the mold it has a solidified strand shell with a thickness of 5 to 10 mm. This can be achieved if the effectively cooled length $1_k$ (m) of the mold (the distance between the casting level and the lower edge of the mold) is so dimensioned as to satisfy the condition $0.05 \cdot v_g$ (m/min) is smaller than/equal to $1_k$ smaller than/equal to 1 m, the value 0.05 being a dimensionally determined component. With this condition adequate heat is withdrawn on an average from the solidifying strand, i.e. approximately $$10^6 v_g^{0.5} \left(\frac{W}{m^2}\right) \text{with } v_g \text{ in } \left(\frac{m}{min}\right).$$

Cooling should be so intensive that the internal surface temperature of the mold remains below 400° C., more particularly between 200° and 400° C. This ensures that a thick enough steel strand for further processing is obtained even when the cast strand has been squeezed. A strand shell of the stated thickness is also resistant enough to withstand forces occurring in the material without the formation of cracks when the cast strand is squeezed.

With a view to an adequate casting speed, it has proved advantageous if after it emerges from the mold the thickness of the steel strand is reduced by up to 75%. However, the strand thickness should not be reduced to a greater extent at this place, since otherwise when the strand is drawn out of the deforming device such high tensile forces must be applied that the strand surface may develop cracks which cannot be welded again even with subsequent further deformation of the strand. To keep the effect of the draw-out forces of the driven drawing-out rollers within bearable limits, having regard to the distance between the start of the zone of engagement of the pair of drawing-out rollers from the lower edge of the mold and the draw-out speed, care must be taken that the stretching ($\epsilon$) stressing the strand shells does not exceed 1% in the not yet squeezed zone of the strand. This can be achieved more particularly by contact pressure rollers whose diameter is between 0.5 and 1 m, and with a distance of less than 0.5 m between the start of the zone of engagement and the lower edge of the mold. In addition the effect of the draw-out forces can be reduced by reducing surface friction by lubrication or surface shaping.

Since in the process according to the invention the temperature of the cast strand material is not equalized prior to the rolling operation, it is particularly essential that the steel strand shall be so cooled as to be given a temperature uniform over the cross-section. The fact is that since the forming behaviour of steel depends heavily on temperature, the finished strip has zones of different thickness if the temperature of the preliminary strip was unevenly distributed. For this reason according to a further feature of the invention the cross-section of the rolled strip is continuously measured downstream of the roll stand, the measured value being compared with a required cross-section, and if the actual cross-section differs from the required cross-section the supply of coolant to the cooling nozzles disposed upstream of the roll stand is readjusted.

In this way it is possible to keep the temperature of the cast strand constant within very narrow limits and to adjust an equal temperature over its width, so that after the rolling a cross-section is achieved, which is true to size over the width.

Other advantageous features of the process and installation according to the invention are set forth in the claims.

Figure 2:
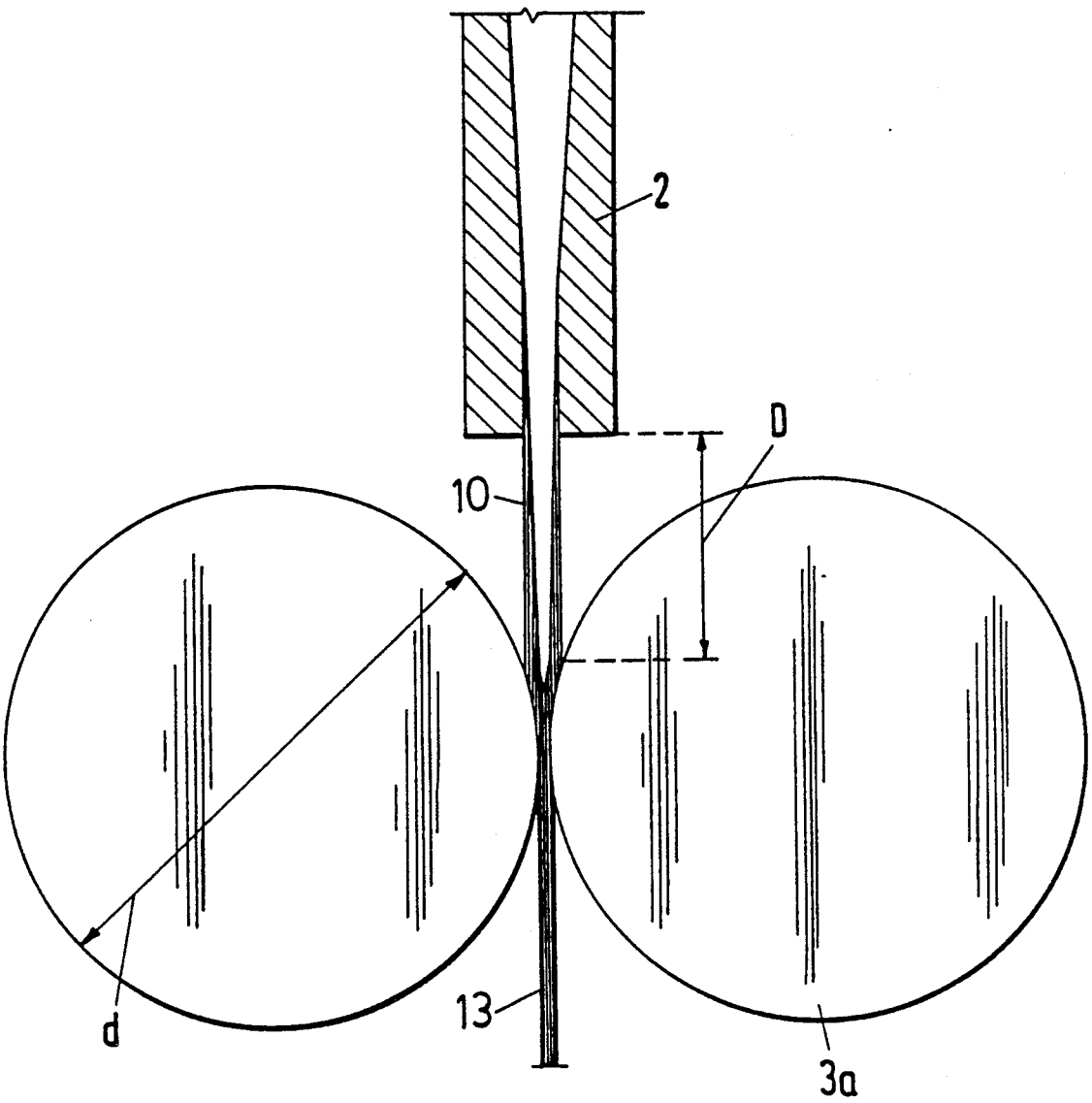

An embodiment of the invention for the production of a steel strip will now be described in detail with reference to the accompanying diagrammatic drawings, wherein:

FIG. 1 is a side elevation of the installation for the performance of the process, and FIG. 2 is a detail, enlarged in relation to FIG. 1, of the installation shown in FIG. 1 in the zone between a mold for continuous casting and a deforming device.

Liquid molten steel flows out of a tundish 1 into an oscillating mold 2 comprising a funnel-shaped upper portion and a lower portion having parallel cooled walls whose distance apart is selected in accordance with the thickness of the strand to be cast. Disposed immediately at the mold outlet is a deforming device 3 by which the strand is squeezed to a thickness of below 25 mm, more particularly 10–20 mm. The deforming device comprises, for example, cooled plates continuing the wide sides of the mold 2 or a corresponding arrangement of driven drawing-out rollers 3*a* which can be adjusted in relation to one another by means of hydraulic cylinders 3*b* to squeeze a cast strand 10. Section-determining supporting rollers should be associated with the narrow sides in the zone of the drawn-out rollers 3*a*. The diameter d of the drawing-out rollers 3*a* should be between 0.5 m and 1 m, while the distance D from the start of the zone of engagement and the lower edge of the mold 2 should be smaller than 0.5 m. If for further processing a strip section with a camber, for example, in the centre of the strip is required, the barrels of the drawing-out rollers can have a correspondingly curved outline. A strip having such a section assists further processing, for example, in a cold rolling mill. However, drawing-out rollers of different sections can also be used, for example, rollers having bottle-shaped barrels.

Disposed downstream of the drawing-out rollers 3*a* is a cooling device 4 which can consist of rib-shaped or grid-shaped cooled plates 4*a*. With such a cooling device cooling liquid is sprayed from nozzles 4*b* between the rods or grids of the plates 4*a* on to the solidifying strand shell.

Disposed immediately downstream of the cooling device 4 is at least one roll stand 5 which rolls out the squeezed strand 13. Utilizing the casting heat, the thickness of the squeezed strand is reduced by 5–85% in the roll stand 5—i.e., the thickness of a strand 10 mm thick is reduced to a minimum thickness of about 2 mm.

Disposed downstream of the first roll stand 5 is a thickness-measuring device 12 which determines the thickness over the cross-section of the rolled strand 10*a* over its total width. The cooling device 4 disposed upstream of the roll stand 5 is controlled in dependence on said thickness determined at this place.

Deflecting rollers 6, another roll stand 7, another cooling device 8, shears 9 and a reel 11 for the coiling of the rolled-out strip 10*b* can be provided downstream of the thickness-measuring device 12.

What is claimed is:

1. An installation for the production of a steel strip having a thickness of less than 25 mm comprising a continuous casting installation having:

a) a funnel-shaped oscillating mold having cooled walls to produce a steel strip having a thickness of 40 to 50 mm; and b) a deforming device disposed at a distance of at most 0.5 m from the mold outlet to squeeze the steel strip to a thickness of not more than 25 mm.

2. An installation according to claim 1, which further comprises a cooling device being disposed downstream of the deforming device and at least one roll stand being disposed downstream of the cooling device.

3. An installation according to claim 1, wherein the deforming device comprises rollers hydraulically adjustable in relation to one another.

4. An installation according to claim 3, wherein the rollers have contoured barrels.

5. An installation according to claim 3, wherein the rollers have a diameter from 0.5 m to 1 m.

6. An installation according to claim 1, wherein the deforming device comprises rollers and further comprising a cooling device having two gratings disposed downstream of the rollers and which continue the wide sides of the mold and having open areas wherein coolant nozzles are disposed.

* * * * *